United States Patent [19]

Watson

[11] 4,396,115

[45] Aug. 2, 1983

[54] DISPLAY CARTON BLANK

[75] Inventor: William H. Watson, St. Louis, Mo.

[73] Assignee: Container Corporation of America, Chicago, Ill.

[21] Appl. No.: 409,092

[22] Filed: Aug. 18, 1982

[51] Int. Cl.[3] ..... B65D 5/44; B65D 5/54

[52] U.S. Cl. ..... 206/44 R; 206/45.14; 206/45.19; 229/42

[58] Field of Search ..... 206/44 R, 44.12, 45.12, 206/45.14, 45.19, 45.31, 45.34, 45.29, 45.26; 229/31 R, 41 R, 42

[56] References Cited

U.S. PATENT DOCUMENTS

| | | | |
|---|---|---|---|
| 2,259,041 | 10/1941 | Larkin | 206/44 R |
| 2,540,342 | 2/1951 | Moore | 229/15 |
| 2,937,742 | 5/1960 | Michiel | 206/44.12 |
| 3,002,609 | 10/1961 | Batkin | 206/45.14 |
| 3,961,706 | 6/1976 | Roccaforte et al. | 206/44 R |

*Primary Examiner*—William T. Dixson, Jr.
*Assistant Examiner*—Brenda J. Ehrhardt
*Attorney, Agent, or Firm*—Richard W. Carpenter; Davis Chin

[57] ABSTRACT

A blank of foldable paperboard cut and scored to provide integral carton-forming and divider-forming sections which are detachably secured to each other.

2 Claims, 3 Drawing Figures

DISPLAY CARTON BLANK

BACKGROUND OF THE INVENTION

1. Field of the Invention

This invention relates generally to display cartons, and more particularly to a novel blank of foldable sheet material, such as paperboard, which is cut and scored to provide a carton forming section and an integral partition forming section detachably connected to each other.

2. Description of the Prior Art

A prior art search in the United States Patent and Trademark office directed to the subject matter of this invention disclosed the following U.S. Pat. Nos. 1,289,518; 1,799,656; 2,178,091; 2,185,544; 2,260,428; 2,937,742; 3,208,583; 3,227,266; 3,285,399; 3,347,356; 3,737,094; 4,000,811; 4,058,206; 4,116,330; 4,213,559.

None of the prior art patents uncovered in the search disclosed a one-piece blank of paperboard cut and scored to provide separate carton-forming and divider-forming sections detachably connected to each other in the manner of the present invention.

SUMMARY OF THE INVENTION

An object of the invention is to provide a blank of foldable sheet material, such as paperboard, which is cut and scored to provide both a display carton and a divider for partition section for the carton which may be detached therefrom prior to its erection and insertion into the carton.

A more specific object of the invention is the provision of a blank of foldable sheet material having certain working score lines on one portion of the structure and other working score lines on a separable portion of the structure, which other score lines cooperate to facilitate the gluing operation in the formation of the carton.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 2:
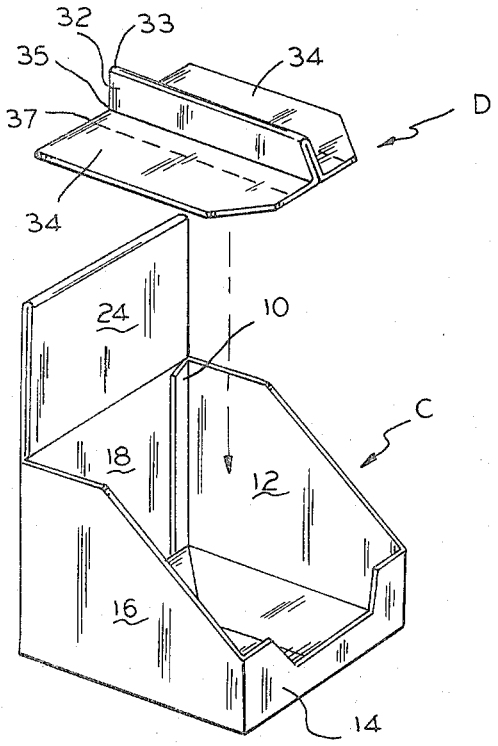
FIG. 2 is an exploded, perspective view of a carton structure and a partition structure formed from the blank illustrated in FIG. 1 and shown in the erected but non-assembled condition.
Figure 3:
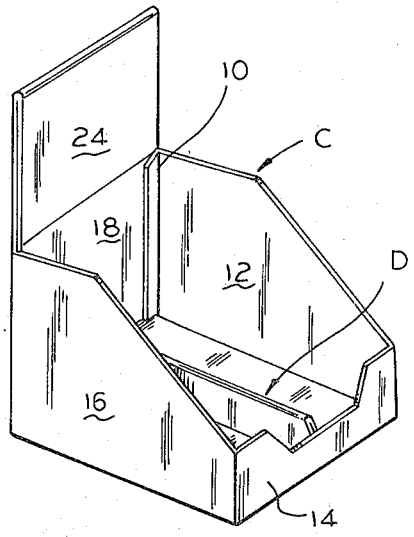
FIG. 3 is a perspective view similar to FIG. 2 but illustrating the carton structure and partition structure in a completely assembled condition.

Referring now to the drawings for a better understanding of the invention, and particularly to FIGS. 2 and 3, it will be seen that there is provided a display carton, indicated generally at C, which has a separate divider or partition member, indicated generally at D, adapted to be inserted on the floor of the carton to divide the interior of the carton into separate compartments.

Figure 1:
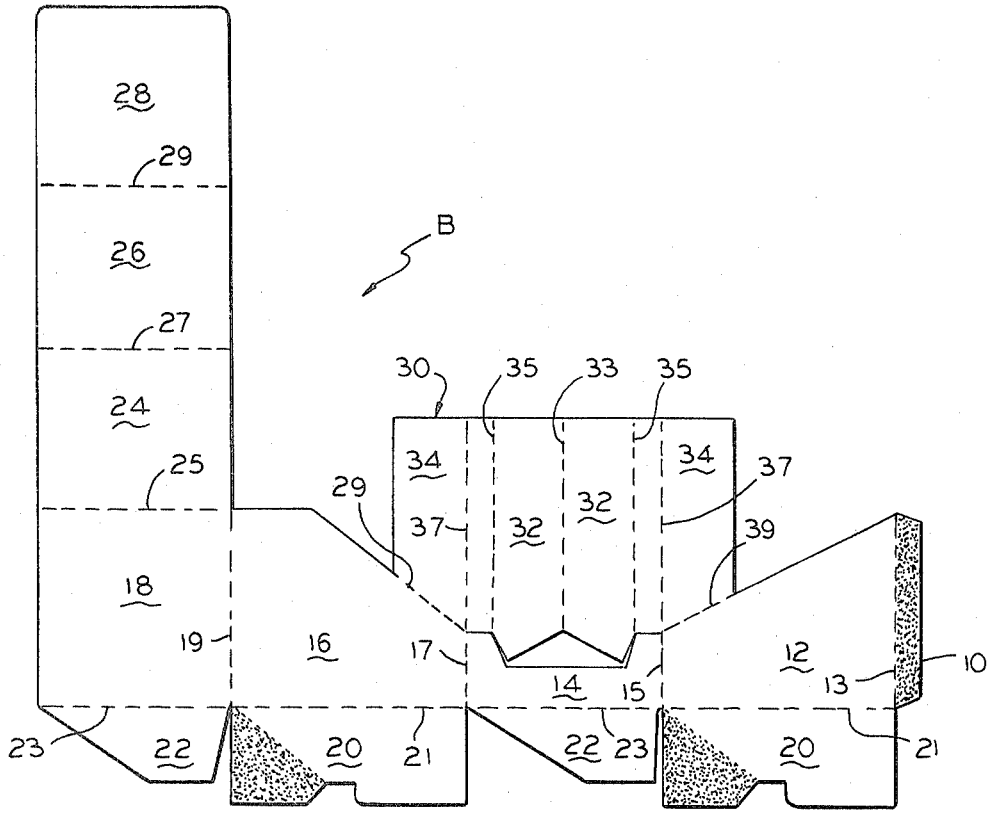
FIG. 1 is plan view of a blank of foldable sheet material embodying features of the invention.

It will be understood that both carton C and divider structure D, though separate, are formed from a common, unitary blank B of foldably sheet material, such as paperboard, illustrated in FIG. 1 of the drawings.

Still referring to FIG. 1, it will be seen that the lower portion of the blank which forms the body of the carton structure includes the following flaps or panels, as seen from right to left: glue flap 10, first end wall panel 12, front side wall panel 14; second end wall panel 16, and rear side wall panel 18, which are foldably joined to each other along parallel fold lines 13, 15, 17, and 19, respectively.

Major and minor bottom closure flaps 20 and 22 may be foldably joined to the lower edges of end wall panels and side wall panels along fold lines 21 and 23, respectively. The bottom closure flaps shown in the drawings are of the type used to provide an automatic bottom, but of course other types of bottom closure flaps may be employed.

Still referring to FIG. 1, it will be seen that foldably joined to one edge of rear side wall panel 18 are a series of extensions 24, 26, and 28 which are foldably joined on fold lines 25, 27, 29, respectively to the rear side wall panel and to each other.

Formed as an integral part of the blank B, but as a section which may be detached and removed therefrom, is a divider section indicated generally at 30.

Divider section 30 includes a pair of separator or center panels 32 foldably joined to each other along a fold line 33 which is parallel to previously mentioned fold lines 13, 15, 17, and 19.

Section 30 also includes a pair of anchor or side panels 34 which are foldably joined on fold lines 35 to adjacent outboard edges of respective center panels 32. Panels 34 are also provided with additional fold lines 37 which are in alignment with fold lines 15 and 17 and which serve as extensions thereof to facilitate folding of the entire blank properly during the gluing operation. These fold lines do not serve any other function, but they do make it possible to glue the blank more accurately than is normally possible with a very narrow blank.

Still referring to FIG. 1, it will be seen that side panels 34 of section 30 are detachably secured to adjacent end wall panels 12 and 17 along diverging weakened lines of tear 39.

It will be understood that the carton is glued together in tubular form so as to be available to the customer for immediate assembly or erection. After the carton has been glued and shipped in a collapsed condition when the customer decides to erect the carton, all he need do is tear off the divider section 30, erect it as shown in FIG. 2, and insert it into the carton, as shown in FIG. 3.

Thus, the invention provides a unique carton blank structure having a carton-forming section and a divider-forming section detachably secured to each for easy removal and assembly.

What is claimed is:

1. A unitary blank of foldable sheet material, such as paperboard, for use in forming an integral display carton structure and a divider structure which are detachably secured to each other, said blank being cut and scored to provide:

(a) a carton structure including:

(i) a front side wall panel;

(ii) a pair of end wall panels foldably joined at corresponding inboard edges to adjacent outboard edge of said front wall panel;

(iii) a rear side wall panel foldably joined at an inboard edge to an adjacent outboard edge of one of said end wall panels;

(iv) bottom closure flaps foldably joined at corresponding inboard edges to adjacent outboard edges of at least certain of said side and end wall panels;

(b) a divider structure detachably secured to said carton structure and including:

(i) a pair of center panels foldably joined to each other along a fold line which extends in a direction parallel to fold lines interconnecting said side wall and end wall panels;

(ii) a pair of side panels foldably joined at corresponding inboard side edges to adjacent outboard edges of related center panels;

(iii) said side panels being detachably secured to respective end wall panels of said carton structure along spaced weakened lines of tear.

2. A blank according to claim 1, wherein at least one of said divider structure side panels has an additional working score line extending in a direction parallel to that of the last mentioned fold line and which serves to facilitate the gluing operation in the formation of the carton.

* * * * *